US007300391B1

(12) United States Patent
Malchar

(10) Patent No.: US 7,300,391 B1
(45) Date of Patent: Nov. 27, 2007

(54) ABDOMINAL AND TORSO STRENGTHENING APPARATUS

(76) Inventor: Richard Malchar, 5720 Valley Oak Dr., Los Angeles, CA (US) 90068

( * ) Notice: Subject to any disclaimer, the term of this patent is extended or adjusted under 35 U.S.C. 154(b) by 0 days.

(21) Appl. No.: 10/658,615

(22) Filed: Sep. 9, 2003

Related U.S. Application Data

(60) Provisional application No. 60/410,133, filed on Sep. 12, 2002.

(51) Int. Cl.
*A63B 26/00* (2006.01)

(52) U.S. Cl. ..... 482/140; 482/62

(58) Field of Classification Search ..... 482/62, 482/140, 148, 907–908
See application file for complete search history.

(56) References Cited

U.S. PATENT DOCUMENTS 3,237,939 A * 3/1966 Olivet et al. ..... 482/69
3,820,781 A 6/1974 Kane
4,852,873 A 8/1989 O'Donnell et al.
4,863,158 A 9/1989 Tassone
4,900,015 A 2/1990 Dissinger
5,120,287 A * 6/1992 Brown et al. ..... 482/69
5,167,600 A * 12/1992 Baird ..... 482/105
5,254,063 A * 10/1993 House, Jr. ..... 482/107
5,299,999 A * 4/1994 Brine ..... 482/105
5,472,398 A * 12/1995 Silverman ..... 482/105
5,580,342 A * 12/1996 Johnson ..... 482/105
5,588,941 A * 12/1996 Scott ..... 482/131
5,792,035 A 8/1998 Ward et al.
5,820,533 A * 10/1998 Goldman ..... 482/124
5,957,818 A * 9/1999 Betournay ..... 482/105
6,022,302 A 2/2000 McBride
6,338,699 B1 * 1/2002 Veitch ..... 482/69
6,368,257 B1 * 4/2002 Kaplan et al. ..... 482/124
6,652,431 B1 * 11/2003 Mattox ..... 482/139
6,770,013 B2 * 8/2004 Stillinger ..... 482/91
6,827,672 B2 * 12/2004 Miceli ..... 482/69

* cited by examiner

*Primary Examiner*—Lori Amerson
(74) *Attorney, Agent, or Firm*—Koppel, Patrick, Heybl & Dawson; Michael J. Ram

(57) ABSTRACT

The present invention is directed to an abdominal and torso strengthening apparatus comprising a frame, cross segments and supporting elements. The frame comprises an arc member and a linear member, wherein the linear member couples to the arc member. The cross segments are rods that extend from the linear member to the arc member and can include a fitting that is configured to receive a weight. The supporting elements are coupled to the frame in a position to allow the strengthening apparatus to rest on the shoulders of the user during use.

9 Claims, 3 Drawing Sheets

ABDOMINAL AND TORSO STRENGTHENING APPARATUS

RELATED APPLICATIONS

This application claims priority under 35 USC § 119(e) from U.S. Provisional Patent Application 60/410,133, filed Sep. 12, 2002, the contents of which are incorporated herein by reference.

FIELD OF THE INVENTION

This invention is directed to an abdominal and torso strengthening apparatus. More specifically, an ergonomically designed exercise apparatus for strengthening the torso and abdominal muscles having a substantially oval shaped frame that rests on the user's shoulders during use thereby minimizing strain to the neck or back muscles.

BACKGROUND OF THE INVENTION

Exercising activity with specialized equipment has increased dramatically in recent years. Indeed, memberships at gymnasiums have substantially increased and the types of home exercise equipment available for use by individuals has grown.

Health issues and the minimization of health problems has become a focus of many individuals. One of the more common health problems experienced by a large segment of society is back pain. In general, back pain can be caused by a variety of factors, including excess weight, stress, improper lifting techniques, and weak abdominal muscles. Most individuals are aware of the types of health issues, including back issues, raised by excess weight, stress and inappropriate use of the back muscles to lift object, and the manner in which to resolve these issues. However, many individuals do not realize that the alleviation of back issues can, in part, be accomplished by strengthening abdominal muscles and the torso.

The torso, and in particular, the abdominal muscles are the 'power house' for the body. Generally, strong abdominal muscles assist in the development and maintenance of good posture and can minimize back pain as a strong abdomen assists in reducing inappropriate use of back muscles and strain of those back muscles.

Some exercise equipment has been developed to address weak back muscles. In particular, one simple apparatus was a straight bar. The straight bar was used by individuals to twist side to side from the waist. In use, the bar was placed behind the neck and across the back of a user. The user wrapped his arms around the portion of the bar that extended beyond his back and twisted side to side from the waist. One problem with this type of apparatus is that the linear configuration of bar caused the neck to be strained backwardly in an unnatural position. The positioning of the neck behind the alignment of the body tended to cause tendon strain in both the neck and back.

Later configurations of this type of equipment utilized yokes in the design such that a portion of the bar wrapped behind the neck. In this configuration, the linear arms of the bar extend slightly in front of the user such that the user's neck was no longer unnaturally tilted backwards during use. One example of this configuration is found in U.S. Pat. No. 3,820,781 to Kane. Although the Kane configuration tended to alleviate the unnatural backward positioning of the neck, the design allowed the apparatus to rest on the base of the neck and shoulders. This type of design can cause fatigue to the user and affect the user's movement during a workout. Further, the positioning of the bar slightly forward of the body allows the yoke to be forced into the back of the neck if the user pushed forward on the bar. Additionally, this configuration limits the muscles exercised as the user is limited in hand placement.

A need in the industry exists for an exercise apparatus that can effectively strengthen the torso and abdominal muscles without straining the neck or back muscles. Further, a need exists for an exercise apparatus that allows for a variety of exercises thereby effectuating a variety of muscle regions in the torso and abdomen.

BRIEF DESCRIPTION OF THE DRAWINGS

The detailed description of embodiments of the invention will be made with reference to the accompanying drawings, wherein like numerals designate corresponding parts in the figures.

SUMMARY OF THE DISCLOSURE

Figure 1:
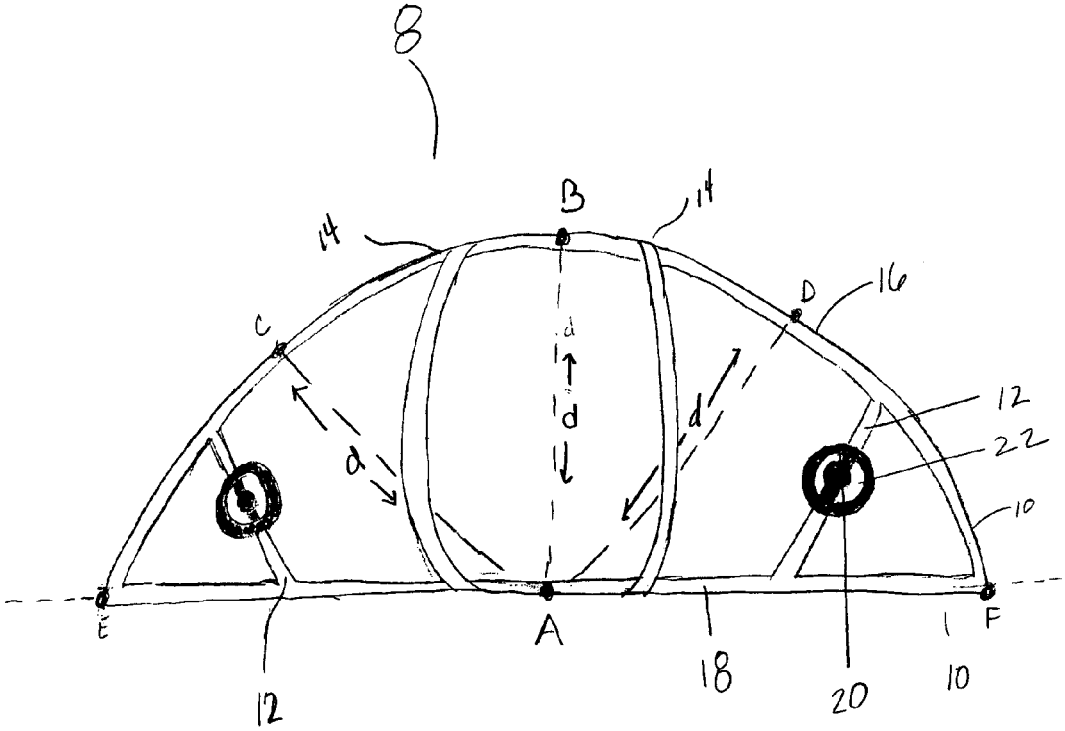
FIG. 1 depicts a strengthening apparatus in accordance with a preferred embodiment of the invention.

Preferred embodiments of the present invention are directed to an abdominal and torso strengthening apparatus comprising a frame, cross segments and supporting elements, wherein the frame comprises an arc member and a linear member. The linear member couples to the arc member to form a semi-oval shape. The linear member of the frame is a single rigid member that couples to the arc member such that a closed frame is formed. In some preferred embodiments, the linear member and the arc member can be made as a single contiguous piece.

The cross segments are rods that extend from the linear member to the arc member. The cross segments include a fitting that is configured to receive a weight. In some embodiments, the cross segments can be manually attached and removed.

The fitting comprises a threaded bar that is configured to receive a weight having an aperture. In some preferred embodiments, the fitting is a separate member which can be manually attached. The fittings are capable of supporting weight attachments, such as a flat donut shaped weight.

The supporting elements are coupled to the arc member and the linear member. In preferred embodiments, the supporting elements are adjustable members and are made from supple or flexible material that is not rigid. The supporting elements are positioned such that they reside on the shoulders of the user during use.

A feature of preferred embodiments is the ergonomic design of the apparatus. An advantage to this feature is that the design provides support and comfort and minimizes the potential for injury during the workout. Another advantage is that it allows replication of natural movements that would be experienced in sports, for example, during a golf swing exercise, the user's hands would slide together, similar to the use of a golf club.

Another feature of preferred embodiments of the invention is that the design of the apparatus causes the apparatus to rest across the back of the shoulder blades. An advantage to this feature is that the apparatus does not rest across the neck and top of the shoulder which can cause pain to the user. A further advantage is that the position facilitates good posture, namely, when the user pushes his arms forward during use of the equipment, the user centers himself inside the apparatus causing a natural pushing back of the shoulders, a natural flattening of the back and an expansion of the rib cage. A further advantage is that the position facilitates good control during the twisting motion as the user's arms are positioned in front of the user in a more natural position, as opposed to being pulled behind the shoulders.

A further feature of preferred embodiments is that padded shoulder straps. An advantage to this feature is that the apparatus is comfortable during use.

A still further feature of preferred embodiments is the option to add or subtract weights to the apparatus. An advantage to this feature is that the difficulty of the workout can be controlled, as the addition and subtraction of weights alters the centrifugal force and resistance experienced by the user.

The above and other advantages of embodiments of this invention will be apparent from the following more detailed description when taken in conjunction with the accompanying drawings. It is intended that the above advantages can be achieved separately by different aspects of the invention and that additional advantages of this invention will involve various combinations of the above independent advantages such that synergistic benefits may be obtained from combined techniques.

DETAILED DESCRIPTION OF THE PREFERRED EMBODIMENTS

Preferred embodiments of the present invention are directed to an abdominal and torso strengthening apparatus. With reference to FIG. 1, the strengthening apparatus 8 comprises a frame 10, cross segments 12 and supporting elements 14. The frame 10 comprises an arc member 16 and a linear member 18, wherein the linear member 18 couples to the arc member 16 such that a closed semi-oval shape is formed. In some preferred embodiments, a semi-circle shape is formed. In some preferred embodiments, the arc member and linear member are hinged such that the apparatus can be folded for easy storage.

In preferred embodiments, the distance d from the center point of the linear member A to any point on the arc (B, C, D, E and F) varies depending upon the location point on the arc. It is to be understood that the length of the radius of the arc member 16 is determined, in part, by the shape formed. Thus, for a semi-circle, the length of the radius is equal from the center point A to all points on the arc B,C,D,E,F. In one preferred embodiment, the distance from the point A to B is approximately 20 inches.

The linear member 18 is a single rigid member that couples to the arc 16 such that a closed frame is formed. The linear member 18 can be coupled to the arc by any suitable means including, but not limited to, an elbow member or a C-clamp. In still other preferred embodiments, the linear member 18 and the arc 16 can be made as a single contiguous piece.

In some preferred embodiments, the linear member 18 can extend beyond the ends of the arc (E,F) (shown in dotted lines). The length of the linear member 18 is dependent, in part, upon the size of the arc 16. In one preferred embodiment, the linear member 18 is 5 feet long.

In preferred embodiments, the frame 10 is a hollow cylindrical tube, such as, for example, a pipe, although the frame can be a solid cylindrical tube. The diameter of the tube is approximately ½" to 1". The frame 10 is made from materials that are malleable and lighter in weight. Some suitable materials, include, but are not limited to, PVC pipe, plastic, metal pipe, alloys and rebar. To increase comfort to the user during use, an outer layer of insulation padding is added over the frame material. In preferred embodiments, the frame 10 weighs approximately 8 pounds, although heavier or lighter designs can be made for different types of users.

The cross segments 12 are rods that extend from the linear member 18 to the arc 16. The cross segments 12 include a fitting 20 that is configured to receive a weight 22. In some embodiments, the cross segments 12 are not included or can be manually attached and removed. In embodiments wherein the cross segments 12 can be manually attached, the linear member 18 and the arc 14 are configured with a coupling member for receiving the cross segments 12. Further, in these embodiments, the cross segments 12 are further configured to couple with the linear member 18 and the arc 16.

The fitting 20 comprises a threaded bar that is configured to receive a weight having an aperture. The weight is secured to the cross segment 12 via a wing nut that mates with the threaded bar. In some preferred embodiments, the fitting 20 is a separate member that is coupled to the cross segment 12 via a clamp or any other suitable means. The fittings 20 are capable of supporting weight attachments, wherein the weights are standard weight attachments currently available in the marketplace, including, but not limited to, a flat donut shaped weight. In some preferred embodiments, the fittings support a minimum of ten pounds.

The supporting elements 14 are coupled to the arc member 16 and the linear member 18 by any suitable means, including, but not limited to, a C-clamp with a wing nut, an elbow or any type of clamping device. In preferred embodiments, the supporting elements 14 are adjustable members and are made from flexible material that is not rigid, including, but not limited to, plastics, leather, cotton, cloth, goatskin, nylon, nylon webbing, heavy nylon, woven nylon. In preferred embodiments, the supporting elements 14 are flat straps and are positioned such that they reside on the shoulders of the user during use. In some preferred embodiments, the supporting elements 14 are composed of materials having high strength and durability such that they are resistant to tearing or breaking. For example, such materials can include the types of materials used for car seatbelts and parachutes. The supporting elements 14 can be adjusted by any suitable means, including, but not limited to, telescopic means and buckles threaded through the material.

Figure 2:
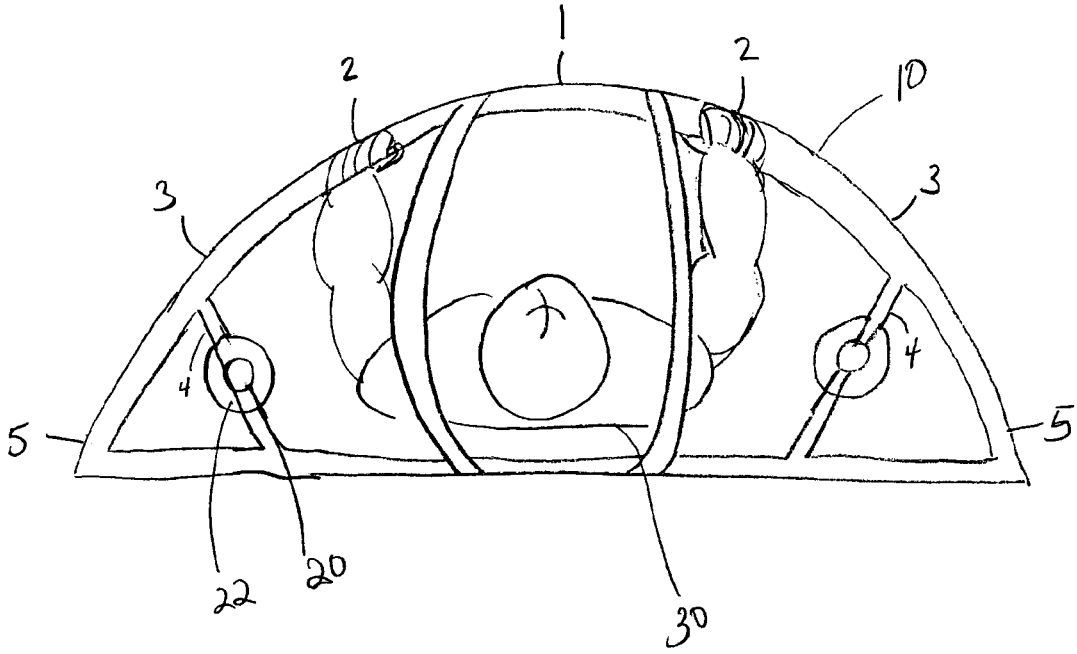
FIG. 2 depicts the exercise apparatus of FIG. 1 resting on a user's shoulder during use.

With reference to FIG. 2, to use the exercise apparatus, a user 30 places the frame 10 around his body and rests the supporting members 14 on his shoulders. The user then places his hand in any one of a plurality of positions. With reference to FIG. 2, the user can place his hands in position 1, position 2, position 3, position 4 or position 5. The position of the hands determines, in part, which muscles are exercised, such as muscles in the abdomen, obliques, arms and shoulders. Additionally, different hand positions facilitate different ranges of motion, centrifugal forces and drag. Further, during use the user can place his hands on the center of the arc 16 and gently push outward. The placement of the hands and the outward force assists in aligning the user's back such that it is straight, and further, allows for greater control of the exercise apparatus. The slight forward force on the arc 16 allows for the linear member 18 to be stabilized against the back of the user without causing strain to the user's neck.

Once the user 30 has placed the frame 10 in position, the user slowly twists his torso from left to right, that is, from side to side, wherein the twisting motion creates a core strengthening centrifugal force and resistance. To alter the exercise and muscles exercised, and to increase the difficulty of the exercise, the user can add weights 22 to the fitting 20. The addition of the weights changes the force and resistance experienced by the user. The strengthening apparatus can be used as a training device for individuals who simply desire to exercise, and further, can be used by professional or amateur athletes for the purpose of training in their sports, including, but not limited to, golf, tennis, baseball, softball, basketball, boxing, martial arts. Further still, the strengthening apparatus enhances stretching, and in addition to abdomens, can exercise obliques and 'love handles'.

Figure 3:
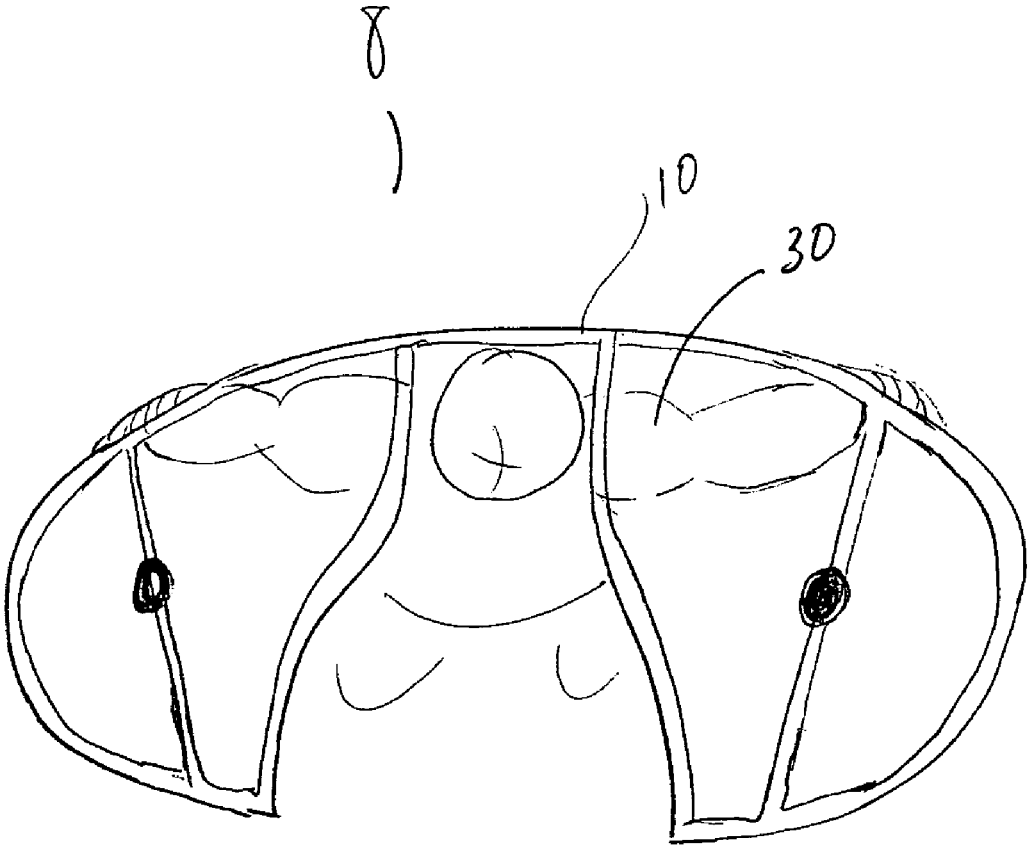
FIG. 3 is an exercise apparatus in accordance with another preferred embodiment of the invention.

It is to be understood that other embodiments bearing similar features of the invention are also intended. For instance, with reference to FIG. 3, in other preferred embodiments, the frame 10 is shaped substantially as an oval and is formed as a single piece. In this embodiment, the frame 10 is an open frame, wherein the frame is slid behind the user's neck and across his shoulders. In this embodiment, the supporting members 12 are contoured to create a spacing for a user's neck. The supporting members 12 can be formed in conjunction with the frame 10 such that the frame 10 and supporting members 12 are a single piece. In other preferred embodiments, the supporting members 12 are formed separately from the frame 10 and the components are coupled together by any suitable means, including, but not limited to, welding.

Although the foregoing described the invention with preferred embodiments, this is not intended to limit the invention. For instance, in still other preferred embodiments, the linear member 18 and arc 16 are telescopic such that each can be extended or shortened depending upon the user's size. Further still, a plurality of cross bar members can be added to the frame 10, such as in a ladder configuration, and thereby allow user's having shorter arms a variety of placements for their hands during exercise. In some embodiments, the additional cross bar members are removable and can be placed in a position most advantageous to the user. Further still, although the frame has been discussed as a solid member, it is to be understood that the linear member 18 and the arc member 16 can be configured to fold such that the exercise apparatus can be folded into a smaller compact unit. For example, a folding mechanism can be placed in the middle of the linear member 18 and the arc member 16 such that the entire exercise apparatus is halved. Rather, the foregoing is intended to cover all modifications and alternative constructions falling within the spirit and scope of the disclosure and the embodiments as described.

What is claimed is:

1. A strengthening apparatus to strengthen the torso and abdominal region, comprising:

a frame having an interior portion;

flexible supporting members, wherein the flexible supporting members are coupled to the frame and positioned to rest on the shoulders of a user, wherein the user is positioned within the interior portion of the frame during use; and cross segments coupled to the frame;

wherein the frame comprises an arc member and a linear member, wherein the linear member couples to the arc member to form a semi-oval shape;

wherein the cross segments comprise a fitting member configured to receive a weight; and wherein the flexible supporting members comprise a first end and a second end, wherein the first end is coupled to the arc member and the second end is coupled to the linear member.

2. An apparatus as claimed in claim 1, wherein the supporting members are adjustable.

3. An apparatus as claimed in claim 1, wherein the cross segments are releasably coupled to the frame.

4. An apparatus as claimed in claim 1, further comprising cross segments coupled to the frame.

5. An apparatus as claimed in claim 1, wherein the fitting member is releasably coupled to the cross segment.

6. An apparatus as claimed in claim 1, wherein the supporting members are contoured to create a spacing for a user's neck.

7. An apparatus as claimed in claim 1, wherein the frame further comprises a hinge mechanism such that the frame can be folded.

8. An apparatus as claimed in claim 1, wherein the arc member further comprises a hinge member, and the linear member further comprises a hinge member, wherein the hinge member of the arc member and the hinge member of the linear member are aligned such that the frame can be folded.

9. That strengthening apparatus of claim 1 wherein the arc member has an opening therein, said opening centrally located between the position where the linear member couples to the arc member.

* * * * *